US005588761A

United States Patent [19]

Seib

[11] Patent Number: 5,588,761

[45] Date of Patent: Dec. 31, 1996

[54] DOCUMENT PRINTER HAVING SKEW DETECTION

[76] Inventor: Ken L. Seib, 806 Daytona Dr., Palm Bay, Fla. 32705

[21] Appl. No.: 569,739

[22] Filed: Dec. 8, 1995

[51] Int. Cl.[6] ..... B41J 11/42

[52] U.S. Cl. ..... 400/579; 400/582; 400/708

[58] Field of Search ..... 400/579, 582, 400/583, 596, 630, 634, 636, 708

[56] References Cited

U.S. PATENT DOCUMENTS

| | | | |
|---|---|---|---|
| Re. 21,110 | 6/1939 | Smith . | |
| 1,727,471 | 9/1929 | Lasker . | |
| 2,692,551 | 10/1954 | Potter . | |
| 2,709,959 | 6/1955 | Beattie . | |
| 2,873,666 | 2/1959 | Stiefel . | |
| 3,012,499 | 12/1961 | Amada . | |
| 3,077,158 | 2/1963 | Hoffman . | |
| 3,136,243 | 6/1964 | Christoff . | |
| 3,151,543 | 10/1964 | Preisinger . | |
| 3,190,957 | 6/1965 | Foley et al. . | |
| 3,348,212 | 10/1967 | Tubinis . | |
| 3,665,852 | 5/1972 | Harrington . | |
| 3,712,210 | 1/1973 | Landis . | |
| 3,832,946 | 9/1974 | Lupkas et al. . | |
| 3,861,301 | 1/1975 | DiMarzio et al. . | |
| 3,942,436 | 3/1976 | Lupkas . | |
| 3,977,319 | 8/1976 | Mogtader . | |
| 4,138,942 | 2/1979 | Hutley . | |
| 4,212,549 | 7/1980 | Edwards et al. . | |
| 4,332,193 | 6/1982 | Noyes . | |
| 4,480,541 | 11/1984 | Grummett . | |
| 4,513,661 | 4/1985 | Melissa et al. . | |
| 4,576,490 | 3/1986 | Isobe . | |
| 4,576,492 | 3/1986 | Sugawara et al. . | |
| 4,661,003 | 4/1987 | Okamori . | |
| 4,951,564 | 8/1990 | Wilson et al. . | |
| 4,953,995 | 9/1990 | Sims et al. . | |
| 4,967,662 | 11/1990 | Clark et al. . | |
| 4,987,448 | 1/1991 | Chikama | 400/579 |
| 5,013,168 | 5/1991 | Yokota et al. . | |
| 5,015,106 | 5/1991 | Robertson et al. . | |
| 5,084,626 | 1/1992 | Dragon et al. | 400/579 |
| 5,088,848 | 2/1992 | De Falco et al. | 400/579 |
| 5,167,456 | 12/1992 | Murakoshi et al. . | |
| 5,184,900 | 2/1993 | Eisner et al. . | |
| 5,201,590 | 4/1993 | Hakkaku et al. . | |
| 5,250,956 | 10/1993 | Haselby et al. . | |
| 5,493,318 | 2/1996 | Negoro et al. | 400/583 |
| 5,524,995 | 6/1996 | Brookner et al. | 400/708 |

*Primary Examiner*—John S. Hilten
*Attorney, Agent, or Firm*—Howard L. Rose

[57] ABSTRACT

A commercially available dot matrix printer is converted to a document printer by removing the tractor feed sprockets and shaft substituting a pinch roller, rubber roller combination, the roller having a shaft connected to the same stepper motor as the tractor shaft; supplying three positions sensors, a load sensor for detecting a document causing it to be stepped by the rubber-pinch roller combination to the printer head-anvil combination where two more laterally spaced sensors are located so as to measure skew of the document and to further processing of the document if both sensors do not detect the presence of a document essentially concurrently and to turn control of the printer over to the printer's control circuits for further processing when both sensors are activated essentially concurrently.

3 Claims, 2 Drawing Sheets

DOCUMENT PRINTER HAVING SKEW DETECTION

FIELD OF THE INVENTION

The present invention relates to printers and more particularly to printers primarily employed to fill out pre-printed forms.

BACKGROUND OF THE INVENTION

There is a recognized need for a portable document printer for filing out forms, for instance, traffic tickets, both in narrow configuration such as used in Maryland and Florida and broad forms such as used in Houston, Tex. Such printers with their appropriate interfaces would permit rapid and accurate issuance of tickets and correct filling out of other types of forms such as salesmen's order forms, formans' orders to the manufacturing floor, faulty equipment notifications, information exchange, fire inspection reports, meter readings, etc.

To date no such portable printers have been available.

OBJECTS OF THE INVENTION

It is an object of the present invention to provide a portable printer for filling out forms.

It is another object of this present invention to provide portable printers for various size forms both as to width and length.

Still another object of the present invention is to employ a dot matrix printer printing 150 cps as a forms printer.

Yet another object of the present invention is to provide a forms printer that may handle single or fanfold sheets of forms.

Another object of the present invention is to provide a portable forms printer that may operate on 12 volts.

It is yet another object of the present invention to provide a printer for pre-printed forms that has no controls other than those built into the printer; the information to be printed being provided as inputs to the print head control.

BRIEF DESCRIPTION OF THE PRESENT INVENTION

The printer mechanism of the present invention is a Brother M1309 IBM emulation. The tractor feed is removed and a rubber covered roller and a set of pinch rollers is added. Also added are three document sensors, a load sensor, a position sensor and a skew sensor. When a document is initially inserted, the load sensor with its associated circuitry causes the printer's stepper motor to advance the document to the position sensor. If the skew sensor indicates no skew the document is stepped through the printer by the internal printer control circuitry until the printer sensor fails to detect a document. At this point the document under outside programming may be stepped through and out of the printer, may remain in the printer and removed by hand or reverse stepped through the printer and out the front.

The stepper motor with the rubber roller driven at the same rate as the original tractor feed, of the original printer mechanism provide a movement of $1/216$ inch or $n(1/216)$ inch per step and insures precise alignment of the printing in the form. If a skew is detected upon initial positioning of the document at the position sensor, the document is simply pulled out and then reinserted.

The above and other features, objects and advantages of the present invention, together with the best means contemplated by the inventor thereof for carrying out the invention will become more apparent from reading the following description of a preferred embodiment and perusing the associated drawings in which:

DETAILED DESCRIPTION OF THE PRESENT INVENTION

Figure 1:
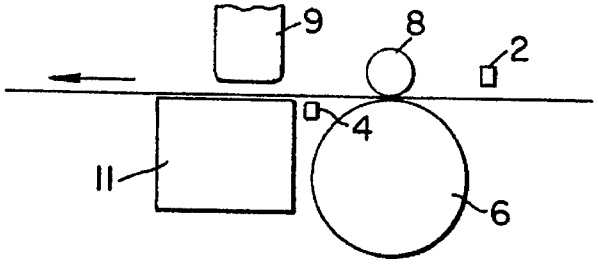
FIG. 1 is a diagrammatic side view of the printer drive and sensor mechanism.

Referring now to FIG. 1 of the accompanying drawings, a load sensor 2 is positioned in the feed path through the printer above the document to be fed. It senses the presence of a document and as will become apparent from FIGS. 4 and 5 causes the document to be fed to the position of the printer sensor 4. Feeding of the document is by rotation of a rubber coated roller 6 with pinch rollers 8, one or three depending upon the width of the printer. The printer in FIG. 3 uses three pinch rollers. The document passes between a print head 9 and a platen 11 as it proceeds through the printer.

Figure 2:
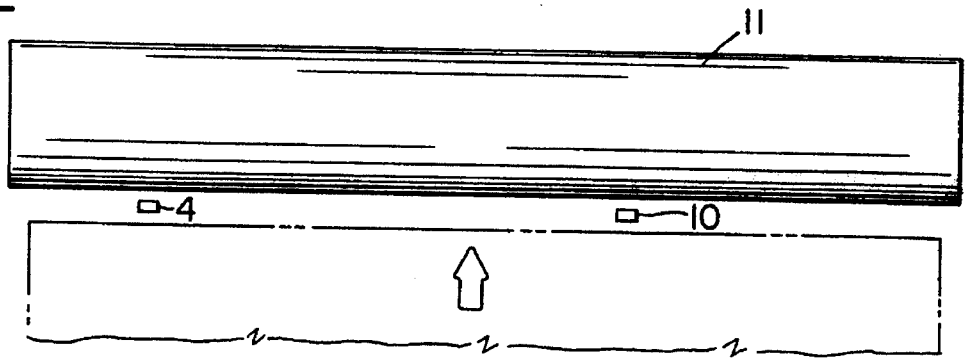
FIG. 2 illustrates the relative lateral positions of the position and skew sensors.

Referring to FIG. 2, a skew sensor 10 in conjunction with position sensor 4 controls further movement of a document. If both sensors detect a document, control of feeding and printing is placed under control of the internal printer circuits of the original device. The document is fed through the printer until the end of the document is detected by the sensor 2 or other control. If both sensors 4 and 10 do not detect a document at about the same time a skew situation exists and further feed does not occur. The document must be withdrawn and reinserted.

Figure 3:
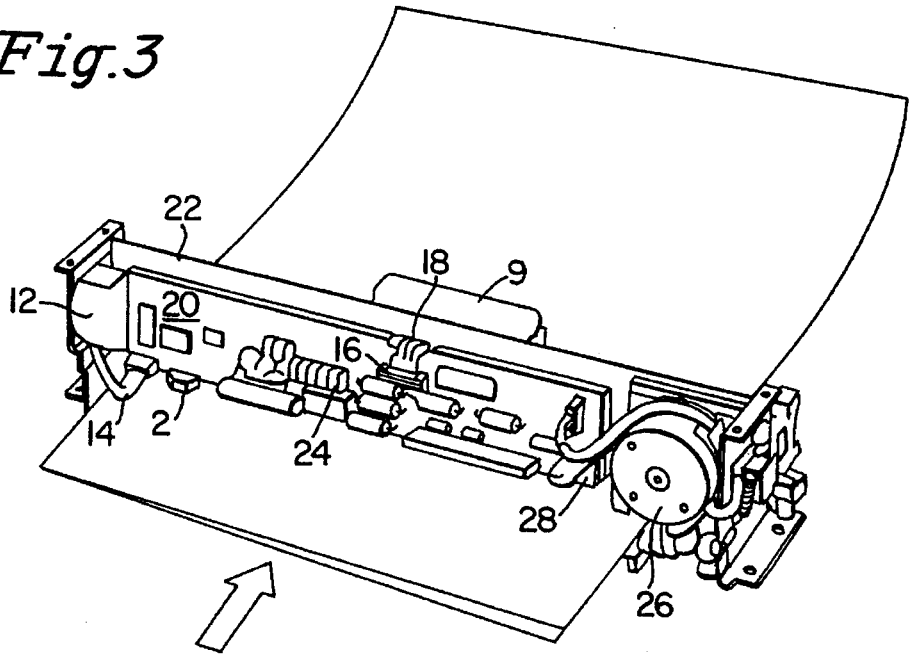
FIG. 3 is a front view of a wide forms printer with the cover removed.

Referring now to FIG. 3, a front view of the interior of the printer is illustrated. A stepper motor 12 (reversible as substantially all stepper motors are), a cable 14 to the motor 12 for receiving stepping pulses from an input connector 16 produces rotation of the roller 6. A flexible cable 18 feeds control signals to the print head 9 through wiring located between printed circuit boards 20 and 22, such being the original circuitry.

Figure 4:
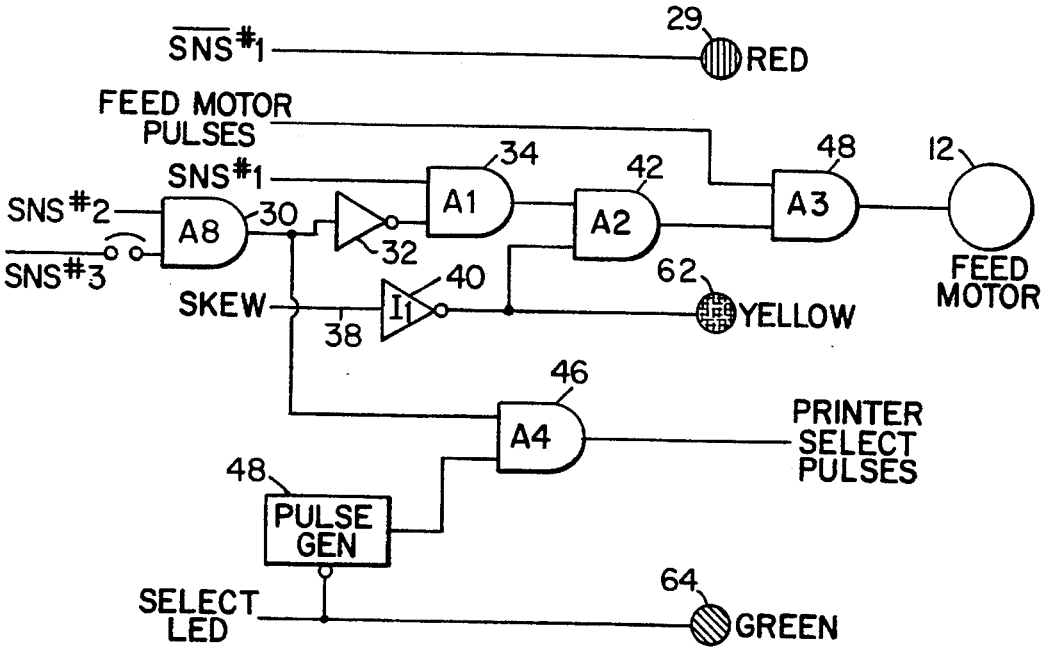
FIG. 4 is a schematic diagram of the stepper motor control.

The load sensor 2 is located in FIG. 4 at the left side of the printer. Integrated circuits 24 for processing input and locally generated information are located on the front wall of PC board 20 as are other circuit elements of the Brother printer. A drive motor 26 fed via cable 28 is located at the right end of the board 20 for transporting the printer head under control of the original printer circuits.

Referring now to FIG. 4 of the accompanying drawings, a document feed motor 12 is under control, at various times, of the sensors 2, 4 and 10 seen in FIGS. 1 and 2.

These sensors control the gating of signals to the feed motor 12 to advance a document from a position at the sensor 2 to the position of the sensors 4 and 10. If a document skew condition is not detected control of the feed motor is turned over to the circuits of the commercial printer which then controls movement of the document through the printer as well as printing on the document.

Initially a red light, LED 29, is energized by a sensor 2 signal ($\overline{\text{SNS}}$ #1) indicating the printer is ready to receive a document. Upon initial insertion of the document in the printer the sensor 2 (SNS #1) applies a high signal to AND gate 30 which receives a low voltage from sensors 4 and 10 (SNS #2 and SNS #3). The sensors are combined emitter detectors that produce a high voltage (SNS) in the absence of paper and produce a low voltage ($\overline{\text{SNS}}$) in the presence of paper since the light is reflected off of the paper to the detector. The low gate 30 is inverted by inverter 32 to provide a gate signal to AND gate 34 as becomes apparent below. If no skew signal is applied to line 38 so inverter 40 applies a gate signal to AND gate 42 which together with the signal from gate 34 sends a signal to gate 48 via gate 42.

Gate 48 passes feed motor pulses to the feed motor and the document is advanced to sensor 4 (SNS #2). Loss of the low signal from sensor 4 stops the motor 12 with the document located just before the print head 9.

The signal from gate 30 is also applied to AND gate 46 to gate pulses from a pulse generator 48 to the printer select pulse output to the printer controls. At that point the document is, as indicated above, at the roller 6; and the movement and printing of the document is placed totally under the control of the printer interface with the printer controlling circuits that form no part of the present invention. The pulse generator 48 is turned off.

Figure 5:
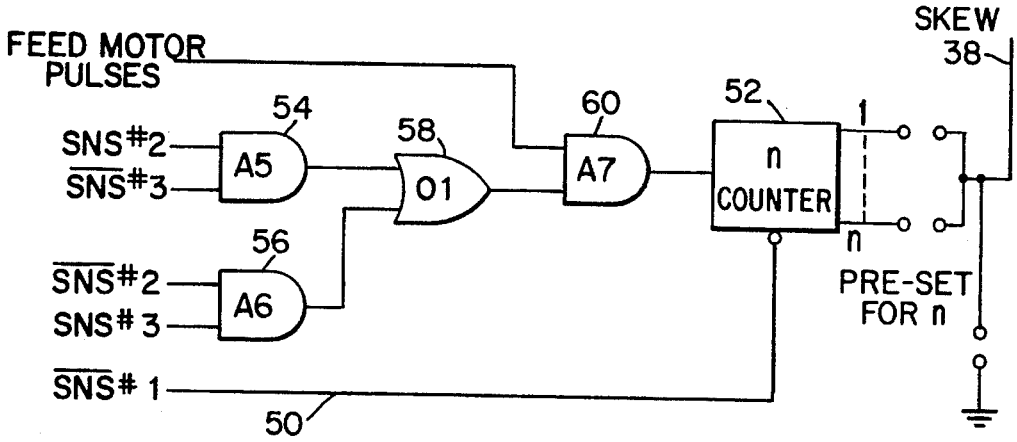
FIG. 5 is a schematic diagram of the skew sensor circuitry feeding the circuitry of FIG. 4.

Referring to FIG. 5 the control of the skew signals is described. No skew signal is produced unless a true skew is detected at which time the circuit of FIG. 4 is disabled unless the gate 46 is energized before a skew signal is developed.

Initially upon sensor 2 being covered, a signal is removed from a lead 50 ($\overline{\text{SNS}}$ #1). The signal ms inverted and used to reset counter 52. The counter provides a skew output on lead 38, if such a condition is detected, see FIG. 4 also. When an output appears on lead 38, the circuit of FIG. 4 is disabled by design at the proper time or if a skew is detected.

Skew is detected if sensors 4 and 10 do not concurrently detect a document. Specifically, if both sensors are covered concurrently within $\frac{1}{216}$ inch or n($\frac{1}{216}$) inch then the circuit of FIG. 4 remains active until the printer controls are activated. If, however, only one of the sensors 4 or 10 is covered AND gate 54 or AND gate 56 passes a signal through OR gate 58 so that feed motor pulse are gated through AND gate 60 to counter 52. When the counter achieves a count of "n" the lead 38 goes high and the gating signal is removed from gate 42. If this condition occurs before control has been passed to the printer, document feed stops and the document must be withdrawn and reset at sensor 2. If the skew condition is detected, a yellow light 62, (FIG. 4) is lit, green light 64 being lit when a select signal is received from the printer indicating operation under control of the printer.

Once the document has cleared all of the sensors, the system is available to receive another document if the Select LED signal is no longer provided. This latter signal is removed only when the printer-input system has completed its task such as stepping the document out either forward or backwards or simply leaves the document in an output region of the printer for removal by hand.

Thus a conventional printer mechanism has been converted to a document printer by the addition of the circuits set forth herein. A document is applied to a commercially available printer, a dot matrix printer preferably, is detected upon insertion, advanced by the rubber roller and pinch roller of the printer to the print station. If the document is properly positioned the printer is placed under control of the printer and input circuits (or other information source) and processed as before modifications by the present invention. Advancement of the document at all stages of the operation is by the printer's stepper motor at the normal incremental step for the printer; initial movement being by the same source of pulses as used by the printer during a printing operation. It should be noted that the rubber roller 6 is mounted on a shaft either the original tractor shaft or another shaft connected to the stepper motor in the same manner as the tractor shaft.

Once given the above disclosure, many other features, modifications and improvements will become apparent to the skilled artisan. Such features, modifications and improvements are, therefore, considered to be a part of this invention, the scope of which is to be determined by the following claims.

What is claimed is:

1. A document printer employing a commercially available dot matrix printer having printer control circuits, an input path, a stepper motor a print head, a platen and with tractors and tractor shaft removed, characterized by a rubber coated roller having a shaft and opposed pinch rollers added in the input path to the printer, said stepper motor connected to said shaft of said rubber roller to produce rotation of said roller, a load sensor positioned in the input path before the roller for sensing a document presented to the roller, circuit means for activating the stepper motor to rotate the stepper motor upon said load sensor sensing a document inserted along the input path, a position sensor located in the input path adjacent the print head for indicating the presence of a document and producing a signal indicative thereof, a skew sensor for producing a signal indicative of the presence of a document laterally of the position sensor at essentially the same location as the position along the path of the document through the printer, and means responsive to all three sensors sensing a document for placing the printer under control of said printer control circuits.

2. A document printer according to claim 1 further characterized by means for preventing the means for placing the printer under, control of said printer control circuits when said position and skew sensors do not sense a document essentially concurrently.

3. A document printer according to claim 2 further characterized by a counter for producing a skew signal upon attaining a predetermined count, said means for preventing becoming effective upon the predetermined count being achieved prior to control of the printer being placed under control of the printer control circuits.

* * * * *